US012559277B1

(12) United States Patent
White

(10) Patent No.: US 12,559,277 B1
(45) Date of Patent: Feb. 24, 2026

(54) METHOD AND APPARATUS FOR OPENING KNOCK DOWN FLAT BOXES

(71) Applicant: Freedom Technologies LLC, Green Bay, WI (US)

(72) Inventor: Barton White, Freedom, WI (US)

(73) Assignee: Freedom Technologies LLC, Green Bay, WI (US)

( * ) Notice: Subject to any disclaimer, the term of this patent is extended or adjusted under 35 U.S.C. 154(b) by 49 days.

(21) Appl. No.: 18/234,524

(22) Filed: Aug. 16, 2023

Related U.S. Application Data

(60) Provisional application No. 63/405,553, filed on Sep. 12, 2022.

(51) Int. Cl.
*B65B 43/26* (2006.01)
*B65B 43/16* (2006.01)

(52) U.S. Cl.
CPC ..... *B65B 43/265* (2013.01); *B65B 43/165* (2013.01)

(58) Field of Classification Search
CPC ..... B65B 43/265; B65B 43/165; B65B 7/20; B65B 43/305; B65B 43/10; B65B 43/145; B65B 59/003; B65B 5/024; B65B 51/067; B65B 43/325; B31B 2100/00; B31B 2120/30; B31B 50/00; B31B 50/78; B31B 50/80; B31B 50/802; B31B 50/062; B31B 50/004; B31B 50/0044; B31B 50/006; B31B 50/804; B31B 2110/35; B31B 2100/002; B31B 50/52; B31B 2100/0022; B31B 2120/302
See application file for complete search history.

(56) References Cited

U.S. PATENT DOCUMENTS

| | | | | |
|---|---|---|---|---|
| 2,989,903 | A | 6/1961 | Wilcox | |
| 3,564,980 | A | 2/1971 | Winters | |
| 3,991,660 | A | 11/1976 | Calvert et al. | |
| 4,011,799 | A | 3/1977 | Chidsey | |
| 4,107,929 | A | 8/1978 | Ebeling et al. | |
| 4,642,966 | A * | 2/1987 | Marchetti | B65B 7/20 493/183 |
| 4,857,038 | A | 8/1989 | Tacchini | |
| 4,915,678 | A | 4/1990 | Morita | |
| 5,588,643 | A | 12/1996 | Tagliaferri et al. | |
| 7,192,393 | B2 | 3/2007 | Makar et al. | |
| 10,640,308 | B2 | 5/2020 | Porteous et al. | |
| 2004/0162207 | A1 | 8/2004 | Ruf et al. | |
| 2007/0293383 | A1 * | 12/2007 | Gebhardt | B31B 50/78 493/313 |
| 2012/0102896 | A1 * | 5/2012 | Dittmer | B31B 50/00 53/381.1 |
| 2013/0121799 | A1 * | 5/2013 | Lundgren | B65G 47/04 414/800 |
| 2020/0039671 | A1 * | 2/2020 | Fox | B31B 50/802 |

* cited by examiner

*Primary Examiner* — Veronica Martin
(74) *Attorney, Agent, or Firm* — Wong Meyer Smith & McConnell

(57) ABSTRACT

A process and apparatus to open knock down flat (KDF) boxes. An End of Arm Tool (EOAT) picks up a flat KDF box off a stack of boxes, opens the box, and tucks at least one of the flaps while the box is being transferred to a conveyor. When the box is released on the conveyor, the tucked flap allows the box to be held open as the top panel of the box rests on or presses against the edge of the flap. The open boxes may then be accumulated and quickly loaded or taped.

13 Claims, 18 Drawing Sheets

METHOD AND APPARATUS FOR OPENING KNOCK DOWN FLAT BOXES

CROSS-REFERENCE TO RELATED APPLICATIONS

This application claims the benefit of U.S. provisional patent application Ser. No. 63/405,553 filed Sep. 12, 2022, the entire disclosure and content of which is hereby incorporated by reference.

BACKGROUND OF THE INVENTION

1. Field of the Invention

The invention relates to a process and apparatus to open knock down flat boxes. This invention takes advantage of the inherent properties of a box to allow it to be held open by tucking at least one flap inward. This allows the box to be simply and quickly transferred and stored in accumulation before it is loaded or taped.

The present invention claims priority to provisional application No. 63/405,553, filed on Sep. 12, 2022.

2. Discussion of the Related Art

Currently in the market, packaging is required for nearly every product. Typically, packaging is required to ship products from a manufacturer to a supplier and a supplier to a customer. A customer rarely receives a product without the product being packaged at some point. Because of the wide use of product packaging, there is a large demand for cheap and efficient packaging.

Knock down flat (KDF) boxes, which are well known in the art, are commonly used for packaging. Often, KDF boxes are made of corrugated board or some other light weight and inexpensive material. KDF boxes have a large variety of uses, one of which is the shipping of consumer products. For example, products shipped to and from retail stores are often packaged in corrugated board KDF boxes.

A prepared and packaged KDF box takes the form of a rectangular prism with six flat sides. Four interconnected panels are attached and folded at 90-degree angles making up the rectangular cross section of the prism. The four panels define an inner volume of the box and have two open ends. Flaps are attached to the ends of the panels near the open ends. Generally, a KDF box includes eight flaps, one for each panel end. The flaps may be folded approximately 90 degrees inward toward the open ends, effectively covering the open ends and closing the box. When used in packaging, the flaps may then be sealed via tape, glue, or some other means to keep the box closed.

When a KDF box is not in use, the box may be folded flat. The attachments between the panels are each able to rotate 90 degrees so that the KDF box folds onto itself. Being able to fold flat is one advantage of using KDF boxes as a flat box takes up significantly less volume and is easier to store. This storage benefit is especially appreciated when a large quantity of boxes is required. Flat KDF boxes may be stacked on top of each other to take up substantially less room than if the boxes were in their ordinary six-sided shape. Generally, manufacturing and supply facilities start the packaging process with a stack of flat KDF boxes. The boxes must then be prepared for use from this flat state. This may include opening the box, sealing the flaps, for example via tape, and loading the box.

Prior to machine automation, KDF boxes had to be prepared individually by hand. A worker would unfurl the panels and fold the flaps to the appropriate locations. Then, the worker would secure the unfurled KDF box by placing a restrictor on some of the flaps. In an attempt to speed up the process, a method was adopted that broke up the unfurling and securing acts of the process into intermediate steps. However, an unfurled box without some support will collapse back to the flat position. Flat pre-creased corners resist being folded and produce residual stresses that tend to force an unfurled box back to the flat position. Further, the weight of the top panel may also further an unfurled box's tendency to collapse flat.

To prevent an unfurled box from falling flat on a table or other surface, a worker would unfurl the panels and fold at least one flap inward. The panel would press against or rest on the folded flap preventing the box from falling flat. The worker could then move on to the next box, leaving this first box at this intermediate open step. The worker could assemble multiple boxes to this open configuration. After multiple open boxes were accumulated on the table or other surface, the final preparation steps, such as taping or loading, could be completed. By splitting up the preparation into intermediate steps, workers avoid inefficiencies of changing tasks or tools, such as grabbing tape or product.

In the current market, KDF boxes are often prepared via an automated machine. For example, some machines in the market today can grab a flat KDF box off a stack of boxes. Furthermore, some machines can unfurl a KDF box. Other machines may be able to tuck flaps and hold the flaps folded or transfer the box to another machine to hold the box open in preparation for taping flaps or loading product. These machines have increased the speed at which a KDF box may be prepared, but a desire for faster and more efficient processes still exists. Additionally, these automated machines routinely run into an issue that typically some percentage boxes within a stack are glued in the flat position preventing the machine from unfurling the box. A worker must manually address this glued shut box causing the machine to experience downtime. As there continues to be a heavy demand for KDF boxes, there continues to be a need to prepare the boxes quicker. With products being packaged in mass quantities, efficiently preparing boxes provides great value.

SUMMARY AND OBJECTS OF THE INVENTION

The disclosed invention improves on prior art by providing a more efficient process and apparatus for opening knock down flat (KDF) boxes. This invention takes advantage of the inherent properties of a box to allow it to be held open prior to loading or taping by tucking at least one minor flap inward. This allows the box to be simply and quickly transferred and stored in accumulation before it is loaded or taped.

This invention may be used in a facility that requires rapid preparation of a large quantity of KDF boxes. Prior to the boxes being prepared, the boxes may be folded flat in a stack. To use a flat box, the box must be opened, loaded, and sealed, for example via taping. The present invention may provide an efficient process and apparatus to open the box.

Generally, a KDF box may include four panels, two major panels and two minor panels. When the box is prepared, each major panel may be opposite the other, and each minor panel may be opposite the other. Each panel may include two flaps connected to each end for a total of eight flaps.

When a box is folded flat, a major panel folds on top of a minor panel. Generally, a flat KDF box on a stack has a major panel and a minor panel exposed on top and a major and a minor panel on bottom.

The present invention uses an End of Arm Tool (EOAT) attached to a machine (herein a box transfer machine) to open a KDF box while the box is being moved from a stack to a conveyor. The invention then uses the inherent properties of a KDF box by tucking at least one flap to keep the box open after it is released by the EOAT. With a flap tucked, the edge of the flap may support the top panel, holding the box open. The open box may then be transferred to a new location on the conveyor.

Initially, the box transfer machine may place the bottom of the EOAT in contact with the top major panel of a KDF box on the top of a stack. The bottom of the EOAT may include a major panel gripper. The major panel gripper may then utilize some grabbing mechanism, for example a vacuum, to hold the major panel against the bottom of the EOAT. The box transfer machine may then lift the EOAT and the attached box off the stack and move the box from the stack to a conveyor.

While the box transfer machine is moving the box to the conveyor, the EOAT may simultaneously open the flat box. The EOAT may include a minor panel arm that extends from the opposite side of the EOAT as the top minor panel. Thus, the minor panel arm extends over the edge of the box. After the box is lifted to an appropriate clearance from the stack, the minor panel arm may rotate underneath the box. The minor panel arm may include a minor panel gripper that may contact the bottom minor panel when the minor panel arm rotates underneath the box. The minor panel gripper may include a grabbing mechanism, for example a vacuum. The minor panel gripper may grab the minor panel holding the minor panel to the minor panel arm. After the minor panel gripper grabs the minor panel, the minor panel arm may rotate approximately 90 degrees in the reverse direction, causing the KDF box to open.

After the KDF box is opened, the EOAT may tuck at least one flap to hold the box open when the box is released on the conveyor. The minor panel arm may include a flap tucker that extends perpendicularly from the minor panel arm in the same direction a flap on the minor panel, a/k/a the minor flap. The flap tucker may rotate toward the minor flap. This rotation pushes the minor flap inward toward the open end of the box. The flap tucker may fold the minor flap approximately 90 degrees or more. The flap tucker may then rotate in the reverse direction to its initial position. However, the minor flap may remain in the tucked position.

As previously stated, while the EOAT may be opening the box and folding a minor flap, the box transfer machine may be moving the box from the stack to the conveyor. After the box is partially erected by being opened and the minor flap tucked, the EOAT may release the partially erected box onto the conveyor.

Generally, an open KDF box that is not held open by some other means will fold flat due to the box's pre-creased stresses or under its own weight. However, in the present invention, the folded minor flap may hold the box open on the conveyor. The top major panel may rest on the edge of the folded minor flap. The minor flap acts as a support. The box may be held open without additional support from the EOAT or another machine. Because an outside support may not be required to hold the box open, the EOAT may release the box several inches above the conveyor. The conveyor may then transport the open box to a new location to be loaded or taped.

The present invention may increase the speed and efficiency of preparing a KDF box. Opening a box is a necessary step in packaging, so having a box held open allows the box to be loaded or taped. The present invention may not require a machine to hold the box open when the box is dropped. This may allow the box to be dropped from several inches above the conveyor, which may double or triple the speed transfer of the box to the next process. Furthermore, the conveyor may transport open boxes to a location dedicated to loading or taping rather than having to open, load, and tape boxes in one location. Open boxes may also be accumulated if a loading or taping process is not immediately available. Additionally, the speed of the process may be improved as the EOAT may open the box while the box transfer machine is also moving the box to the conveyor, accomplishing two tasks simultaneously.

In one embodiment, the present invention of a box opening tool includes a body and a first gripper connected to the body. An arm extends from the body and may rotate around a horizontal axis. A second gripper is connected to the arm. Further, a finger extends perpendicularly from the arm and may rotate around an axis parallel to the arm. The box opening tool may be connected to a machine that positions and moves the body. The box opening tool may also be in the vicinity of a conveyor. In one embodiment, the box transfer machine may have duplicate assemblies containing a body, a first gripper, an arm, a second gripper, and a finger. The first and second gripper may also be vacuums.

The present invention may also include a method of opening a flat box. The method provides a box opening tool with a first gripper connected to a body. An arm extends from the body and may rotate around a horizontal axis. A finger extends perpendicularly from the arm and may rotate around an axis parallel to the arm. The method includes abutting the first gripper with a first panel of the box at a first location and gripping the first panel. The box opening tool and box are lifted vertically, and the arm unfurls the box. The finger rotates to push a flap to the tucked position. The box is transported to a second location and dropped at the second location such that the box remains unfurled.

Yet another embodiment of the present invention for a machine for opening a box includes a body with a first gripper connected to the body. The first gripper holds a first panel of the box. An arm extends from the body and may rotate around the edge of the first panel such that the arm contacts a second panel of the box. Further, a finger extends perpendicularly from the arm and may rotate such that the finger pushes a flap of the box inward when the box is unfurled.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE INVENTION

The present invention and the various features and advantageous details thereof are explained more fully with reference to the non-limiting embodiments described in detail in the following description.

Figure 1:
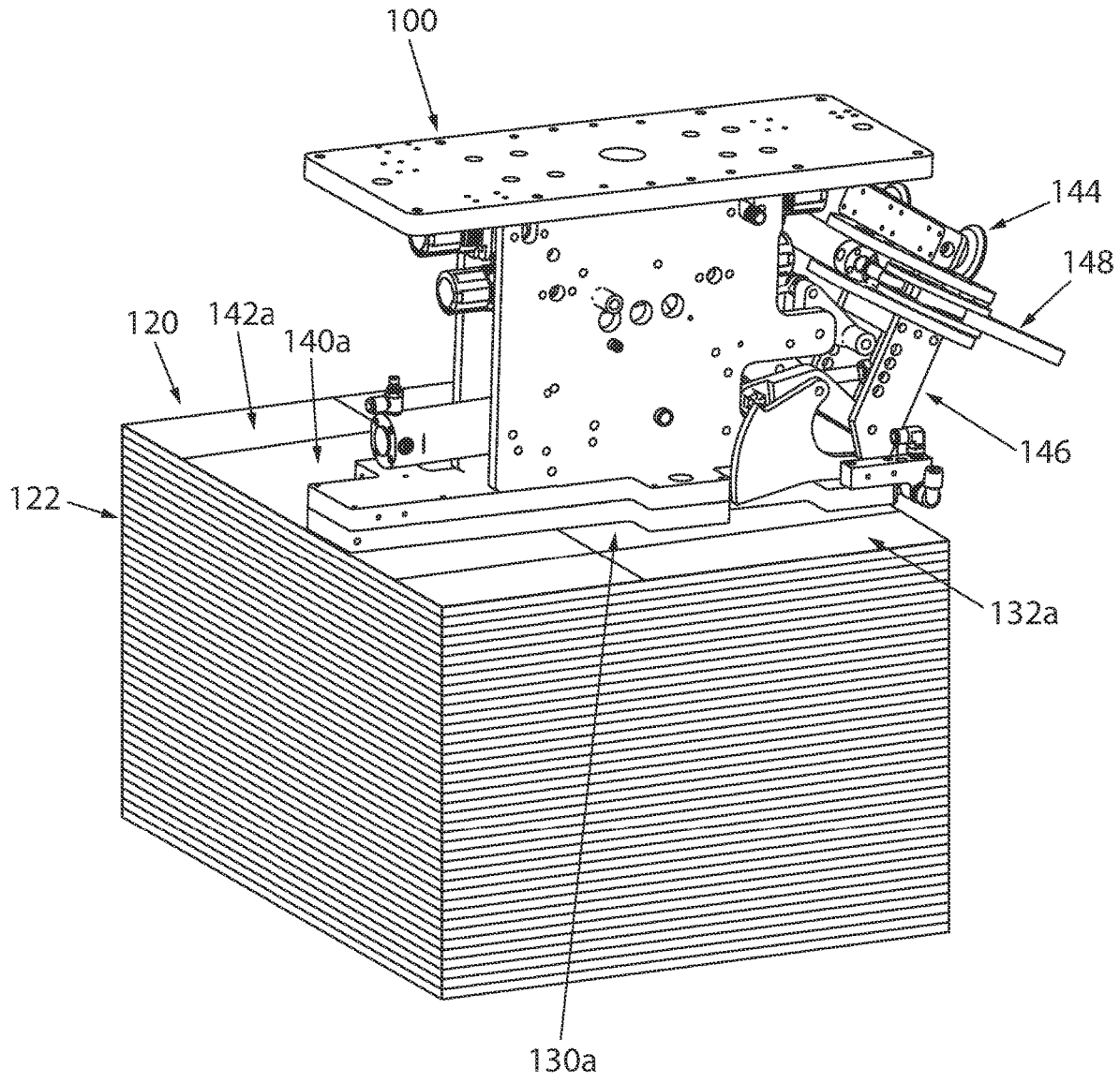
FIG. 1 illustrates an EOAT contacting a major panel on a KDF box on top of a stack.

FIG. 1 depicts a stack 122 of knock down flat (KDF) boxes 120. KDF boxes 120 are foldable boxes 120 that are generally constructed of light weight and cheap material. For example, many KDF boxes 120 are constructed of corrugated board. One advantage of KDF boxes 120 is the ability fold flat making the boxes 120 easier to store when not in use. KDF boxes 120 are often used to package products. Generally, packaging facilities receive the boxes 120 unprepared and in a stack 122. These facilities may need to open, load, and seal these boxes 120 to use as packaging.

A KDF box 120 includes interconnected panels and flaps. Generally, a KDF box 120 may include four rectangular panels connected along foldable edges. When a box 120 is unfurled, the box 120 may be a rectangular prism with two open ends and a rectangular cross section. Of the four panels, two panels may be major panels, 130*a* and 130*b*, and two panels may be minor panels, 140*a* and 140*b*. When the box 120 is open, the major panels, 130*a* and 130*b*, may be opposite each other, and the minor panels, 140*a* and 140*b*, may be opposite each other. Generally, the two major panels, 130*a* and 130*b*, are approximately the same size, and the two minor panels, 140*a* and 140*b*, are approximately the same size. Despite the labeling as "major" and "minor," the major panels, 130*a* and 130*b*, are not necessarily larger than the minor panels, 140*a* and 140*b*. Rather, the labeling refers to how the inventive apparatus interacts with the panels. FIGS. 2-18 depict boxes 120 in which the major panels, 130*a* and 130*b*, are of equal size to or smaller than the minor panels, 140*a* and 140*b*. Typically, the major panels, 130*a* and 130*b*, are larger than the minor panels, 140*a* and 140*b*, though.

A flap may be connected to the end of each panel. Generally, a KDF box 120 may include eight flaps. Four of the flaps may be major flaps, 132*a* and 132*b*, and four of the flaps may be minor flaps, 142*a* and 142*b*. The major flaps, 132*a* and 132*b*, are connected to the ends of each major panel, 130*a* and 130*b*. The minor flaps, 142*a* and 142*b* are connected to the ends of each minor panel, 140*a*, and 140*b*. At the connection point, the flaps may be able to fold inward toward the open ends of the box 120.

Figure 2:
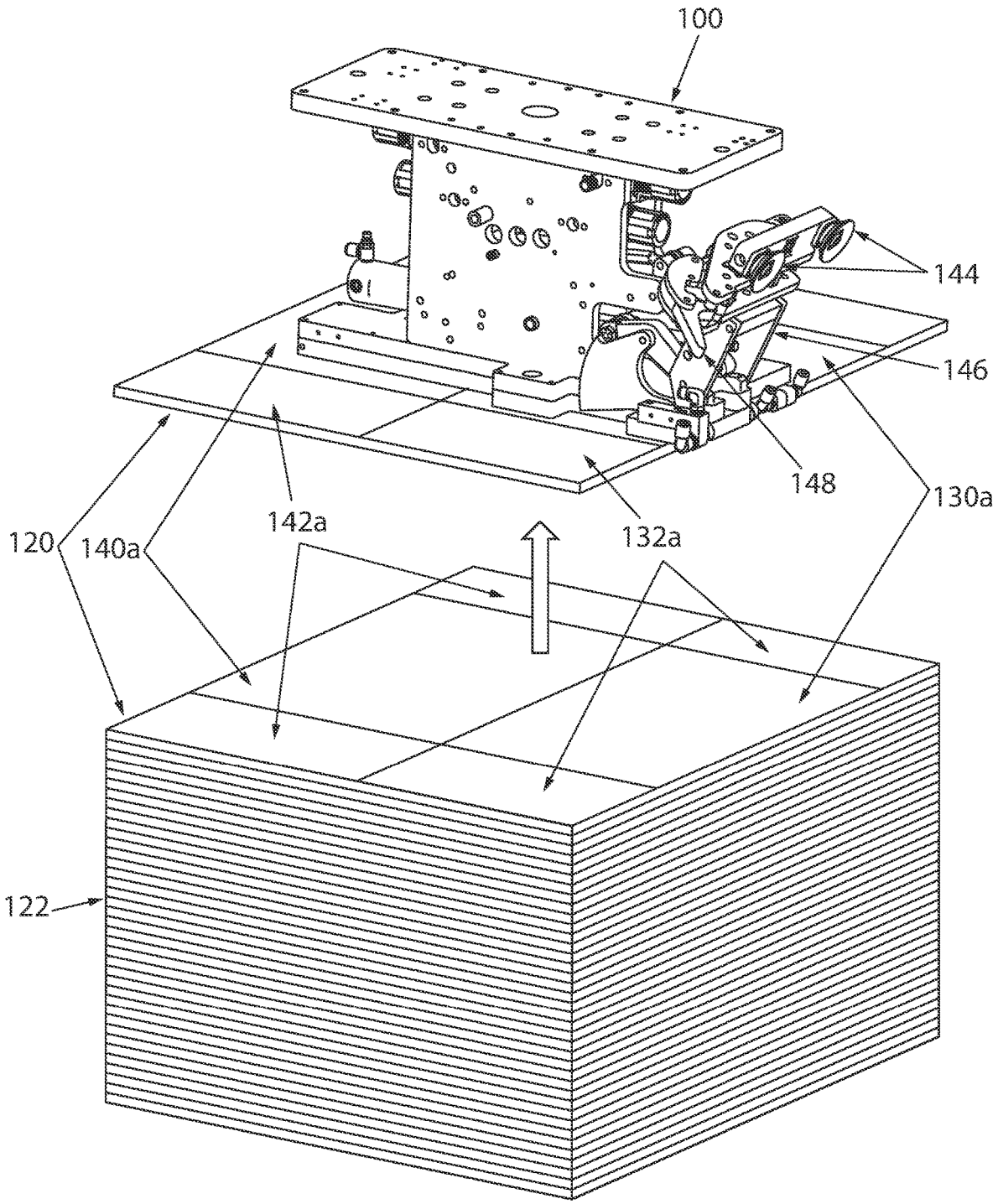
FIG. 2 illustrates an EOAT grabbing a major panel and lifting a KDF box off a stack.

As shown in FIG. 2, a KDF box 120 may fold flat and be placed on a stack 122 of other KDF boxes 120. When folding a KDF box 120 flat, a major panel 130*a* may fold on top of a minor panel 140*b*. The other minor panel 140*a* may fold on top of the other major panel 130*b*. When lying flat, this leaves a major panel 130*a* and a minor panel 140*a* on top and a major panel 130*b* and a minor panel 140*b* on bottom. To use a KDF box 120, the flat box 120 must be taken from the stack 122 and opened.

Figure 7:
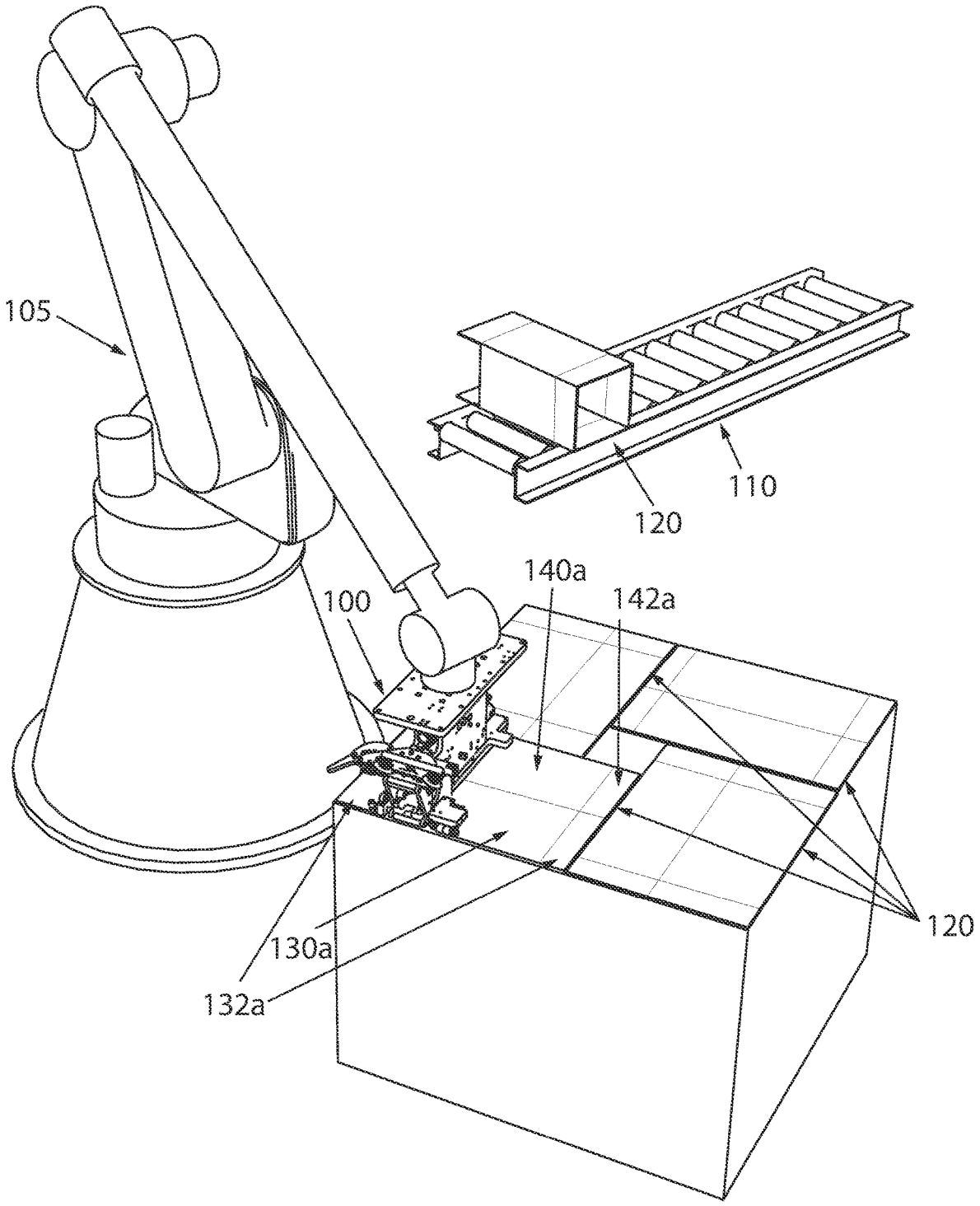
FIG. 7 illustrates a box transfer machine positioning an EOAT over a major panel of a KDF box.
Figure 8:
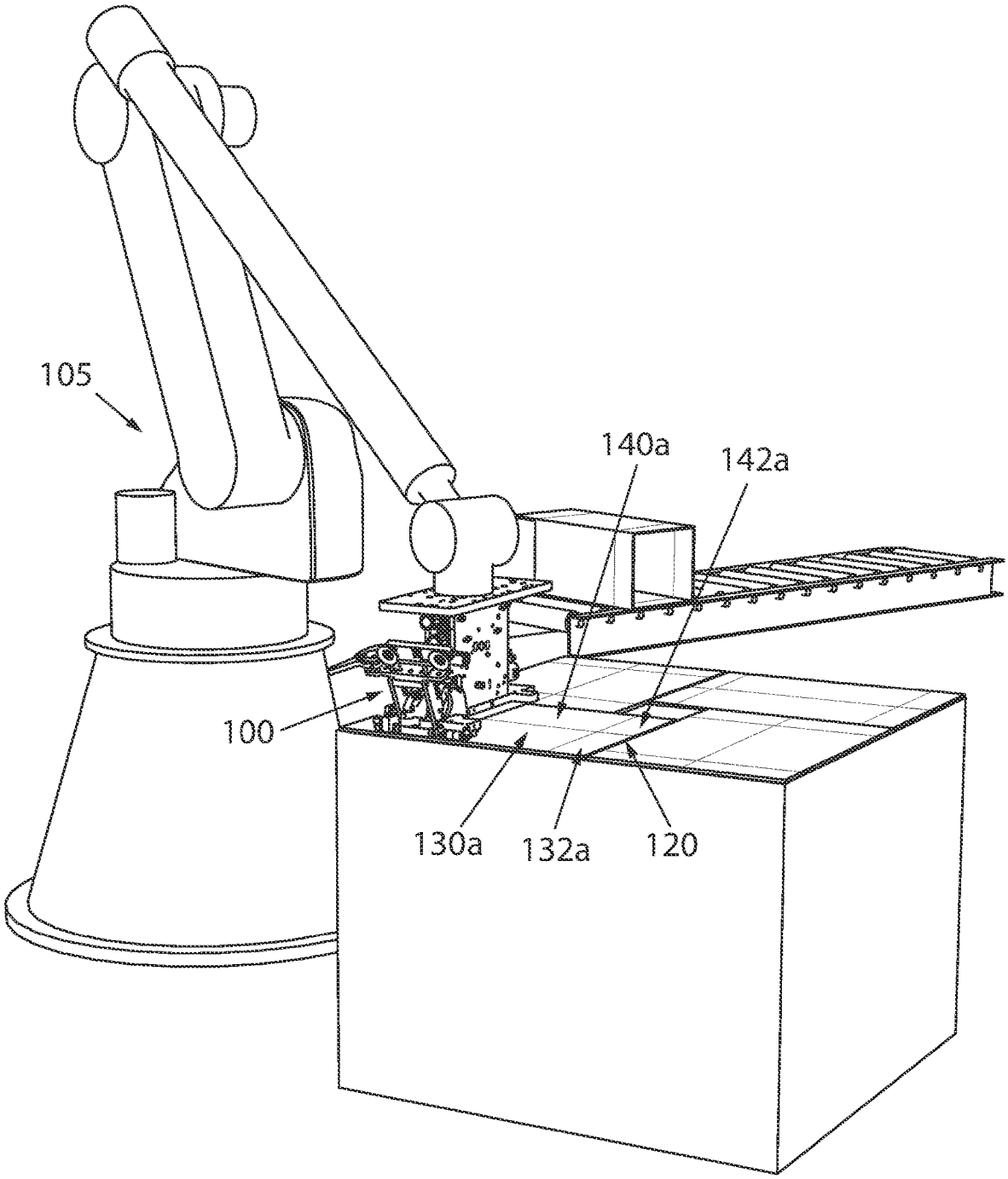
FIG. 8 illustrates a box transfer machine causing an EOAT to contact a major panel of a KDF box.

An End of Arm Tool (EOAT) 100 attached to a box transfer machine 105 may be used to open a flat KDF box 120. As shown in FIG. 7, an automated box transfer machine 105 may position an EOAT 100 above a major panel 130*a* of a flat KDF box 120 on a stack 122. The EOAT 100 may also be referred to as the body of the present invention. As illustrated in FIGS. 1 and 8, the box transfer machine 105 may lower the EOAT 100 so that the bottom of the EOAT 100 contacts the top major panel 130*a*.

A major panel gripper (not shown) may be included on the bottom of the EOAT 100. The major panel gripper may have the ability to grab, or in other words grip, the major panel 130*a*. A major panel gripper may be a vacuum capable of providing sufficient suction to hold the major panel 130*a* to the bottom of the EOAT 100. The vacuum may be energized when the bottom of the EOAT 100 contacts the major panel 130*a*. In one embodiment, the major panel gripper may include one or more vacuum suction cups on the bottom of the EOAT 100. When the bottom of the EOAT 100 contacts the major panel 130*a*, the major panel gripper may be energized causing the major panel 130*a* to be held to the EOAT 100.

Figure 9:
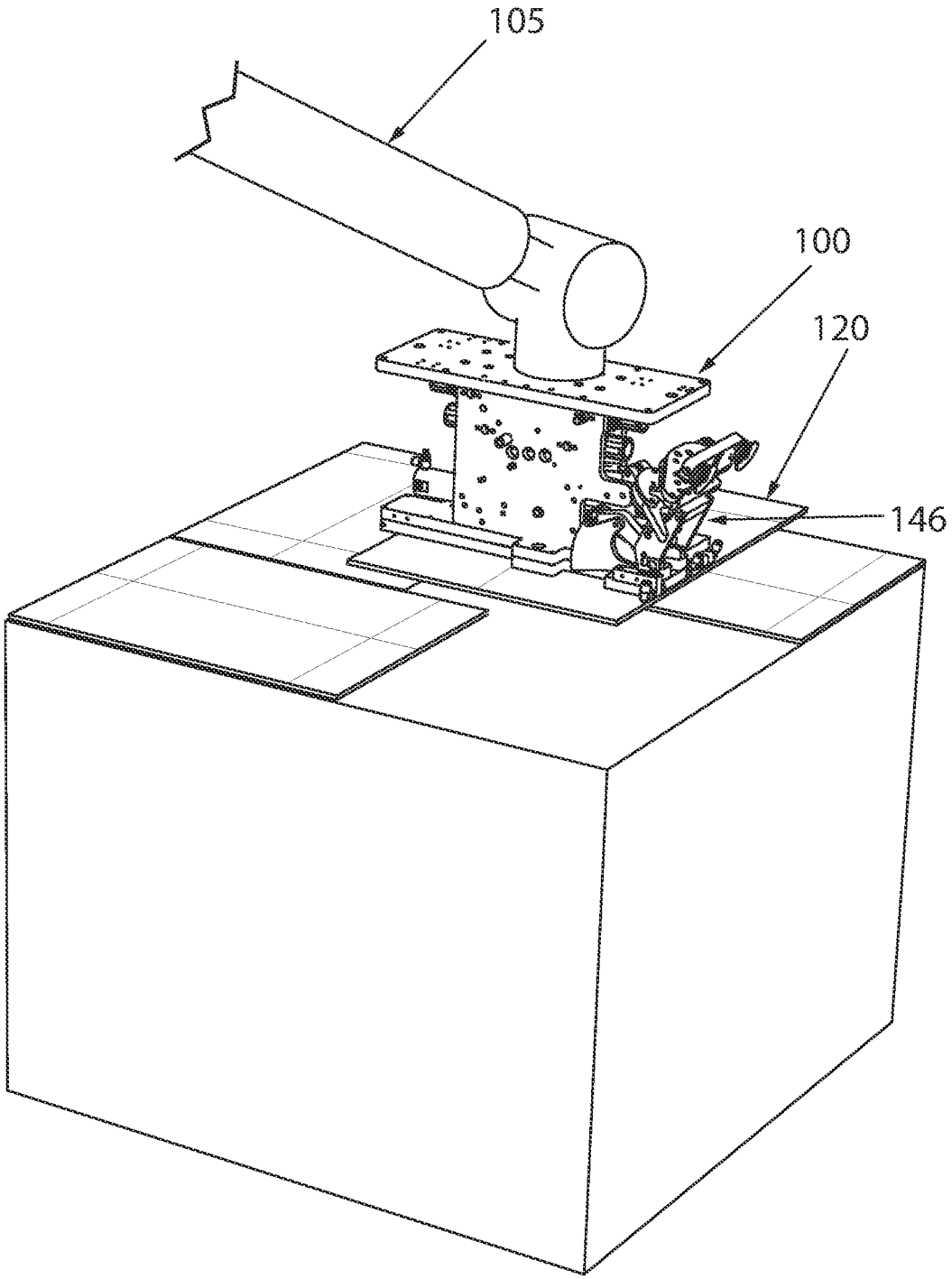
FIG. 9 illustrates an EOAT grabbing a major panel of a KDF box as a box transfer machine lifts the EOAT and the KDF box.

As illustrated in FIGS. 2 and 9, after the major panel gripper grabs the major panel 130*a*, the KDF box 120 is lifted off the stack 122. The box transfer machine 105 may move the EOAT 100 away from the stack 122. Because the major panel 130*a* is held to the EOAT 100 by the major panel gripper, the box 120 moves away from the stack 122 with the EOAT 100. As the box 120 is lifted off the stack 122, the box 120 may remain flat, as shown in FIGS. 2 and 9. Alternatively, the weight of the bottom major panel 130*b* and minor panel 140*b* may cause the box 120 to unfurl partially or fully.

After lifting the box 120 off the stack 122, the present invention may begin to accomplish two tasks simultaneously. The EOAT 100 may open the box 120. While the EOAT 100 opens the box 120, the box transfer machine 105 may move the box 120 from the stack 122 to a conveyor 110 or other secondary location. The present invention may increase the speed of preparing a KDF box 120 for packaging by completing both tasks simultaneously.

As illustrated in FIG. 2, the EOAT 100 may include a minor panel arm 146. The minor panel arm 146 may extend from the EOAT 100 on the opposite side of the EOAT 100 as the top minor panel 140*a*. The minor panel arm 146 may extend over the edge of the box 120. The minor panel arm 146 may include a minor panel gripper 144. The minor panel gripper 144 may be positioned on the bottom side of the minor panel arm 146 when the minor panel arm 146 extends perpendicularly from the EOAT 100 and parallel with the box 120. In one embodiment, the minor panel gripper 144 may include a vacuum. In a similar embodiment, the minor panel gripper 144 may include one or more vacuum suctions cups positioned near the end of the minor panel arm 146.

Figure 3:
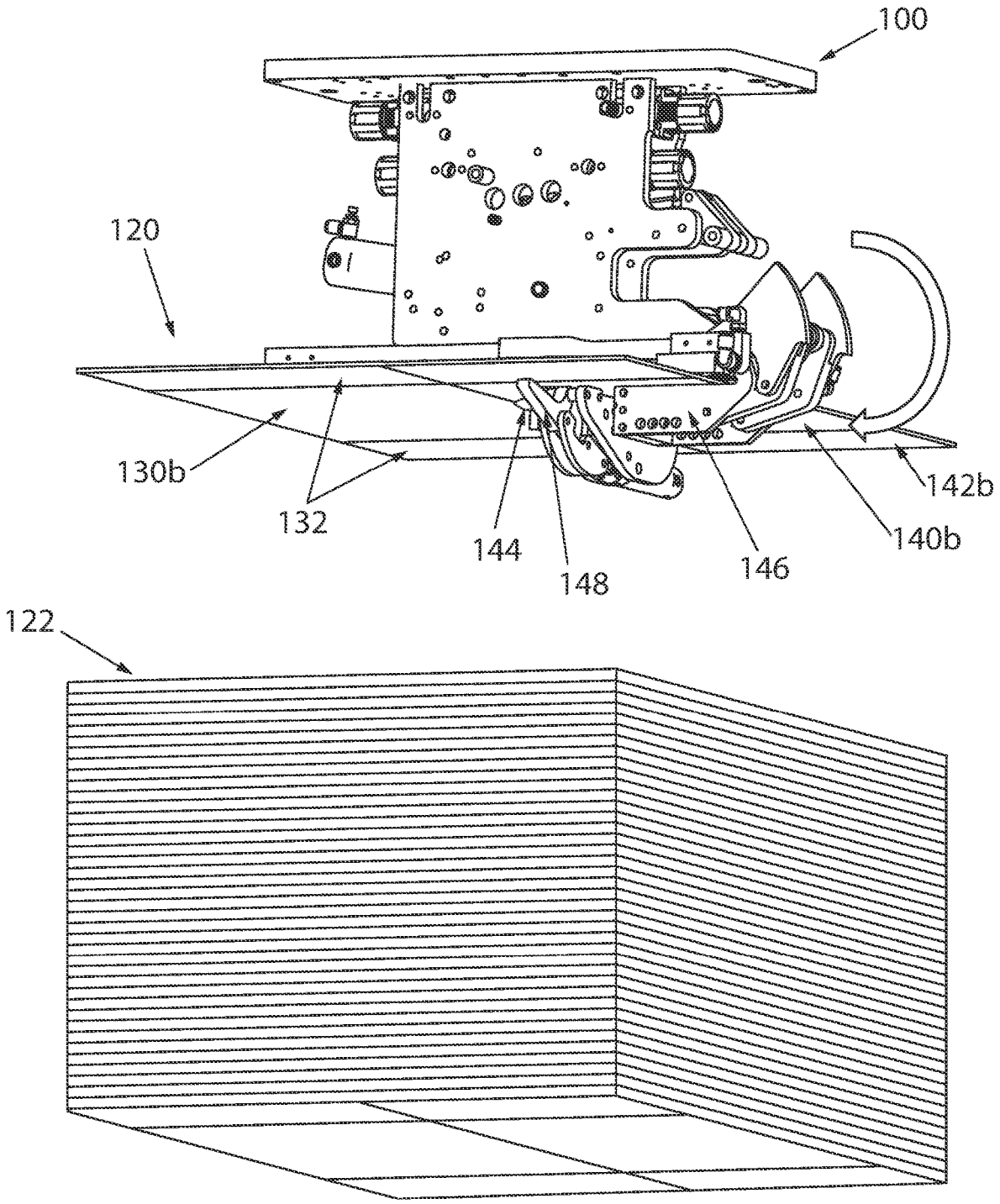
FIG. 3 illustrates a minor panel arm on an EOAT rotated underneath a KDF box and contacting a minor panel.

The minor panel arm 146 may be connected to the EOAT 100 via a rotating joint. This rotating joint may allow the minor panel arm 146 to rotate underneath the KDF box 120. The EOAT 100 may be positioned near the edge of the major panel 130*a*, as shown in FIG. 2, so that the minor panel arm 146 may rotate around the edge of the box 120. In other words, the minor panel arm 146 has freedom of movement to rotate around a horizontal axis. As illustrated in FIG. 3, the minor panel gripper 144 may be rotated to the top side of the minor panel arm 146. In other words, the minor panel arm 146 rotates such that the minor panel gripper 144 is orientated above the minor panel arm 146. The minor panel gripper 144 may contact the minor panel 140*b* on the bottom side of the box 120. In one embodiment, the minor panel arm 146 may start at an angled position of approximately 70 degrees from a horizontal axis. The minor panel arm 146 may then rotate approximately 250 degrees so the minor panel gripper 144 contacts the minor panel 140*b*. In another embodiment, the minor panel arm 146 may have varying starting positions or degrees of rotation. In yet another embodiment, the minor panel arm 146 may not move until the box transfer machine 105 moves the EOAT 100 a sufficient distance away from the stack 122 to provide enough clearance for the minor panel arm 146 to rotate under the box 120.

The minor panel gripper 144 may protrude from the minor panel arm 146 so the minor panel gripper 144 may make a flush connection with the minor panel 140*b*. As illustrated in FIG. 2, the minor panel gripper 144 may include one or more vacuum suction cups that protrude from the minor panel arm 146. The protrusion may allow a flush connection with the minor panel 140*b*. Another embodiment may include a curved minor panel arm 146 to provide a flush connection. Yet another embodiment may include both a protruding minor panel gripper 144 and a curved minor panel arm 146.

Figure 4:
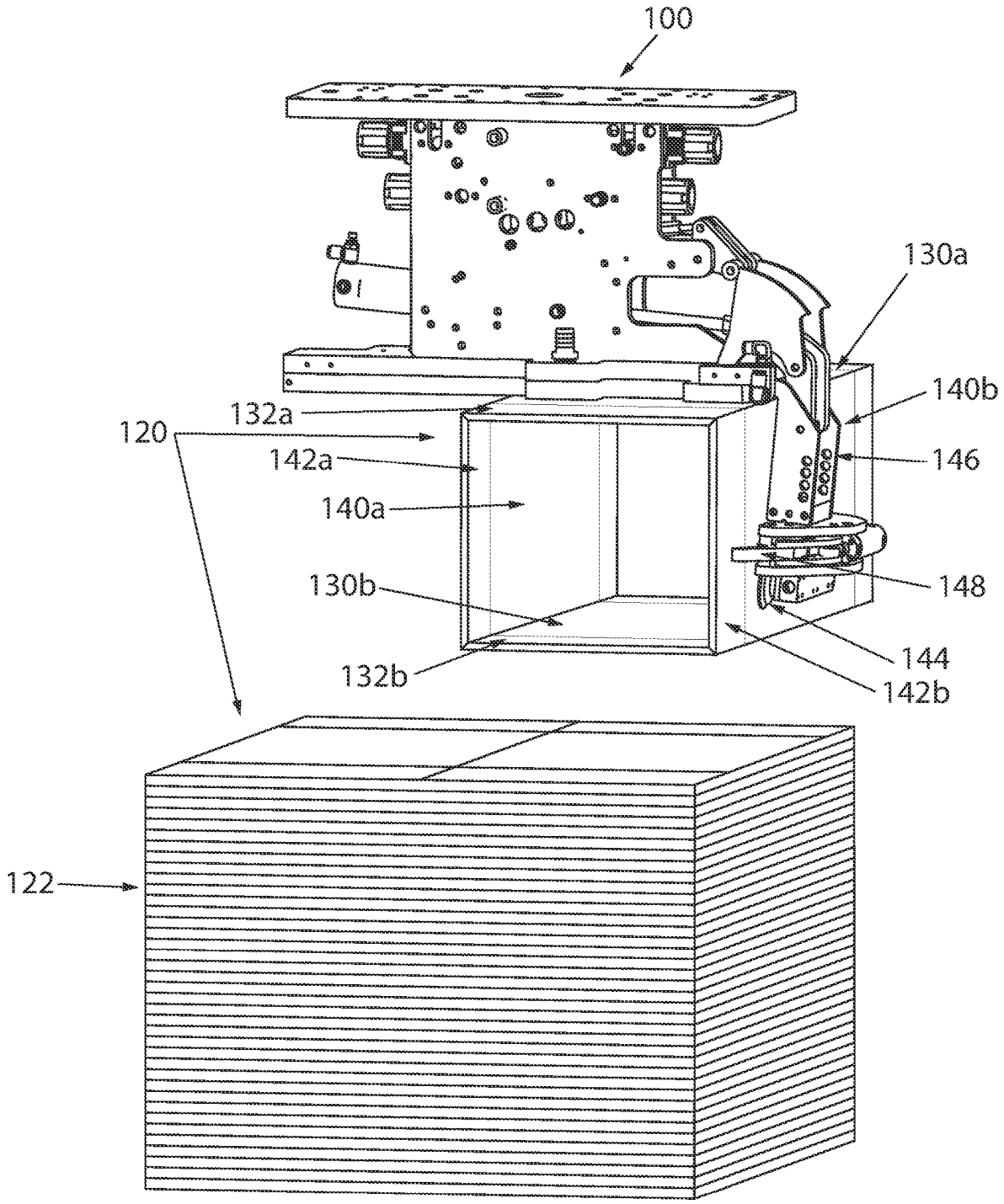
FIG. 4 illustrates a minor panel arm rotated approximately 90 degrees in the reverse direction as a minor panel gripper grabs a minor panel, which unfurls a KDF box.

As illustrated in FIG. 4, after the minor panel gripper 144 contacts the minor panel 140*b*, the minor panel gripper 144 may grab the minor panel 140*b* and open the box 120. When the minor panel gripper 144 is in contact with minor panel 140*b*, some grabbing mechanism may be enabled. For example, the minor panel gripper 144 may be a vacuum that provides sufficient suction to hold the minor panel 140*b* against the minor panel gripper 144. After the minor panel 140*b* is held against the minor panel gripper 144, the minor panel arm 146 rotates in the reverse direction. The minor panel 140*b* may move with the minor panel arm 146, which may cause the box 120 to unfurl or partially erect. In one embodiment, the minor panel arm 146 may rotate approximately 90 degrees in the reverse direction causing the minor panel 140*b* to be perpendicular with the major panel 130*a*. Once unfurled, the box 120 may have a rectangular cross section.

In yet another embodiment, the minor panel arm 146 may push the top minor panel 140*a* to unfurl a box 120. Rather than the minor panel gripper 144 gripping the bottom minor panel 140*b* and the minor panel arm 146 rotating in the opposite direction, the minor panel arm 146 may be arranged to rotate toward the top minor panel 140*a*. The minor panel arm 146 may rotate to contact the top minor panel 140*a*. This rotation and contact push the top minor panel 140*a* downward causing the box 120 to unfurl.

Figure 5:
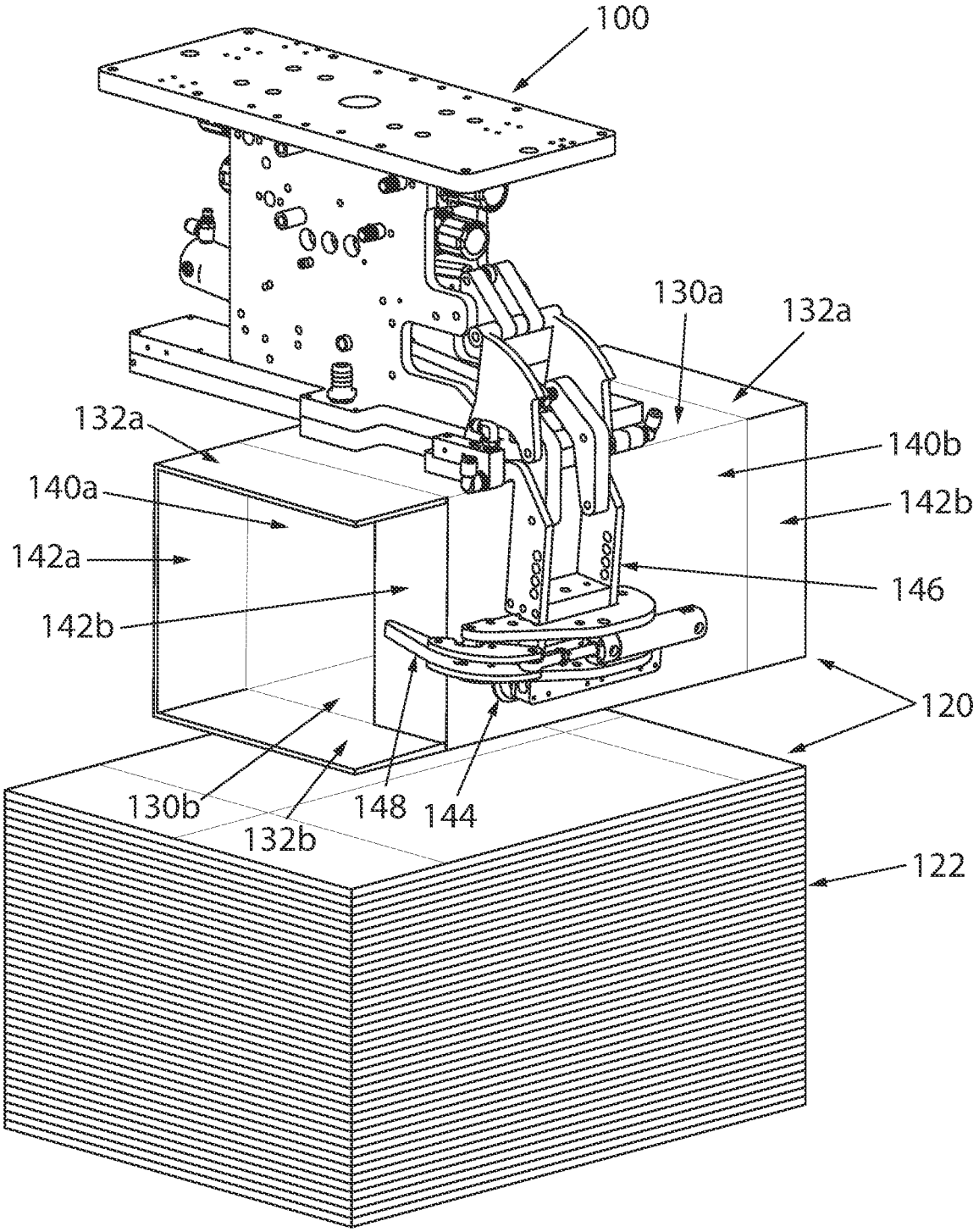
FIG. 5 illustrates a flap tucker rotated approximately 90 degrees causing a minor flap to fold inward.
Figure 10:
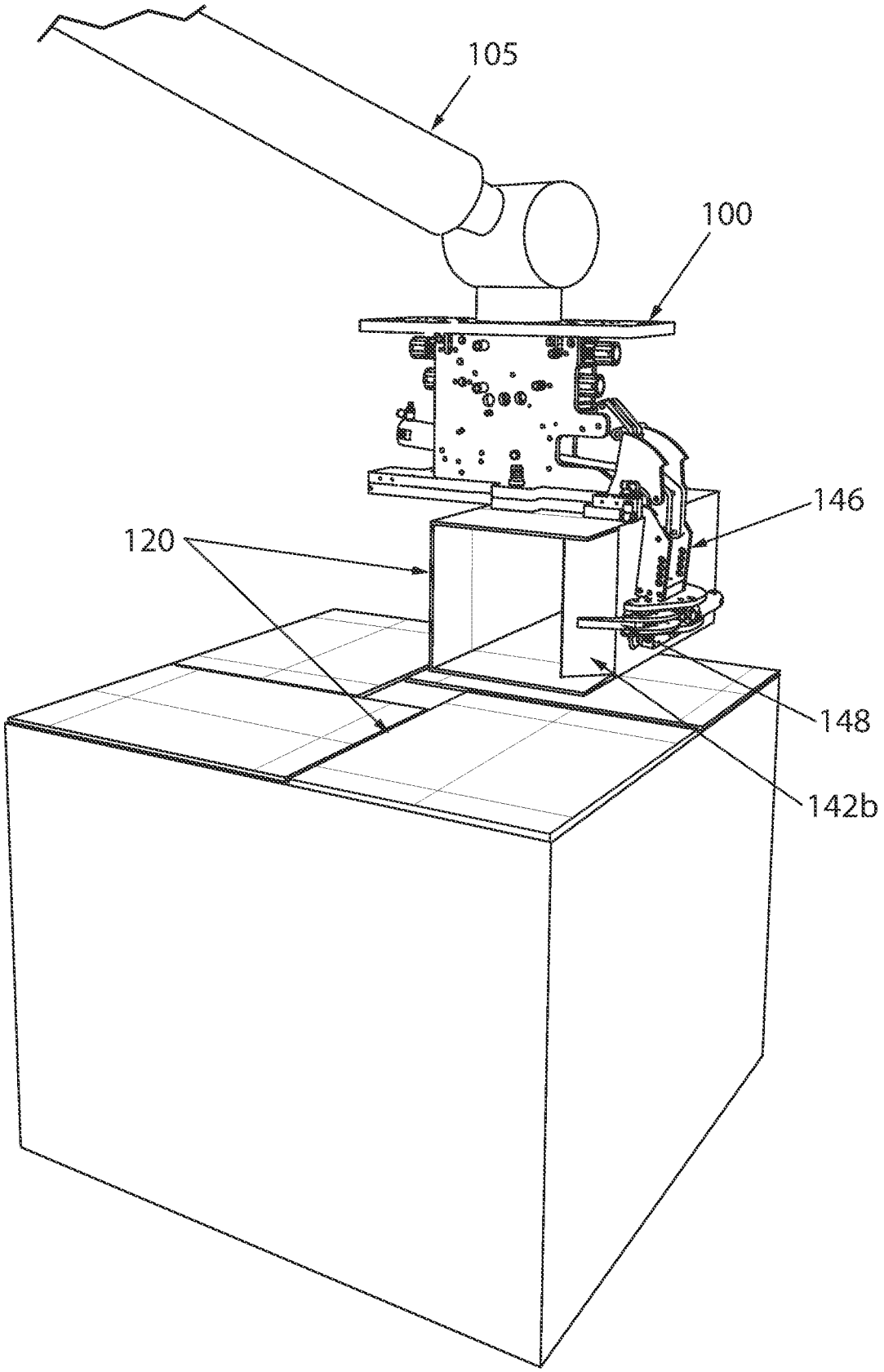
FIG. 10 illustrates a minor panel arm gripper grabbing a minor panel of an open KDF box as a flap tucker folds a minor flap inward.
Figure 11:
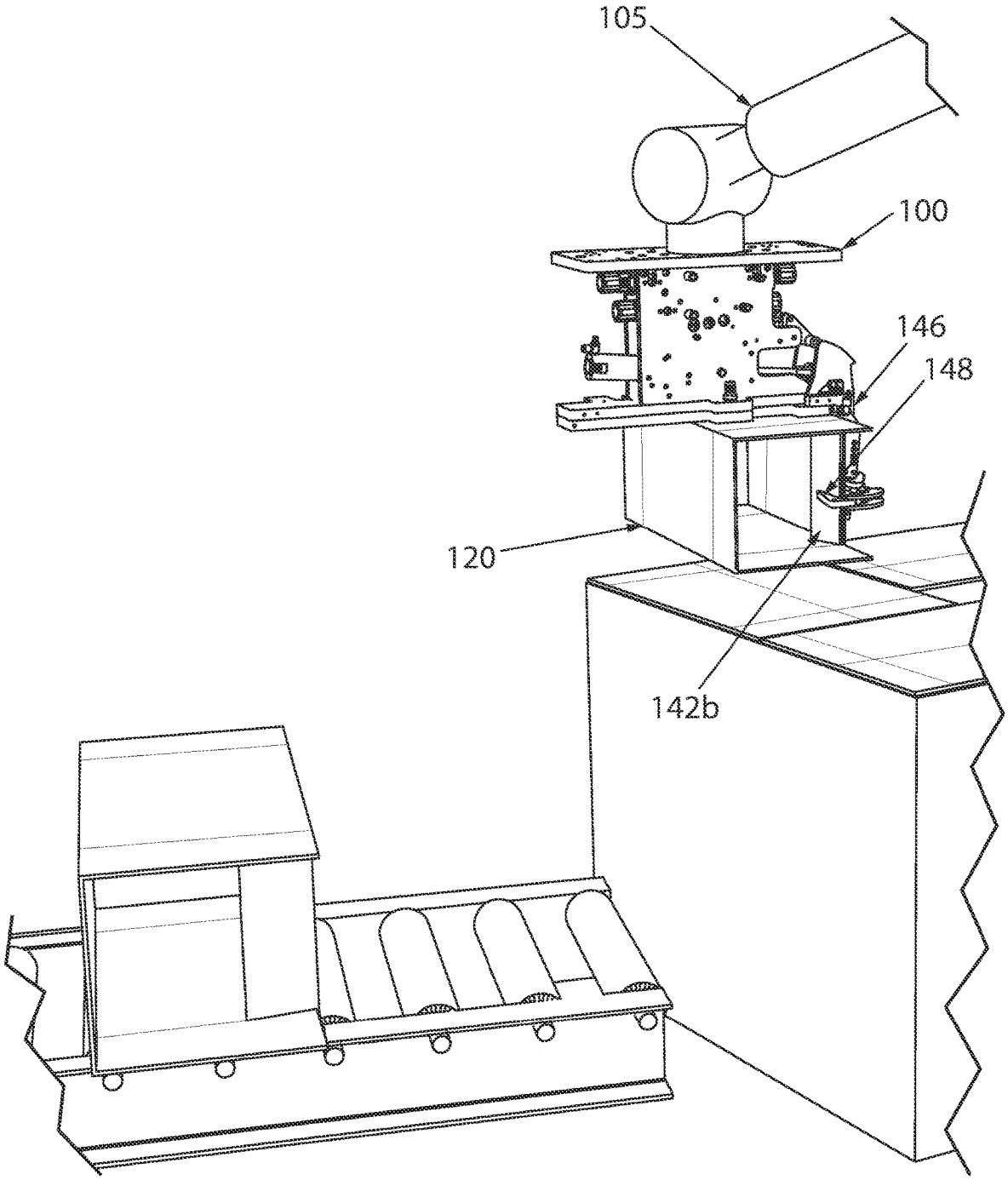
FIG. 11 illustrates a flap tucker folding a minor flap of a KDF box inward as a box transfer machine moves the KDF box toward a conveyor.

As shown in FIGS. 5, 10, and 11, the minor panel arm 146 may also include a flap tucker 148, or otherwise referred to as a finger. The flap tucker 148 may extend perpendicularly from the minor panel arm 146 in the same direction that the minor flap 142*b* extends from the minor panel 140*b*. The flap tucker 148 may be connected to the minor panel arm 146 via a rotating joint allowing the flap tucker 148 to rotate toward the minor flap 142*b* and the open end of the box 120. The flap tucker 148 may be able to rotate around the end of the minor panel 140*b*. In other words, the flap tucker 148 may have the freedom of movement to rotate around an axis parallel to the minor panel arm 146. The EOAT 100 may be positioned near the bottom end of the major panel 130*a*, as shown in FIG. 5, to allow the flap tucker 148 to rotate around the minor panel 140*b*. In one embodiment, the flap tucker 148 may be curved to allow the flap tucker 148 to rotate around the minor panel 140*b*.

After the EOAT 100 opens the box 120, the flap tucker 148 may fold the minor flap 142*b* inward. As the flap tucker 148 rotates, it may push the minor flap 142*b* inward toward the open end of the box 120. The flap tucker 148 may rotate approximately 90 degrees causing the minor flap 142*b* to fold inward until the minor flap 142*b* is approximately perpendicular with the minor panel 140*b*. In another embodiment, the flap tucker 148 may rotate more than 90 degrees causing the minor flap 142*b* to be folded inward so that the angle between the minor flap 142*b* and the minor panel 140*b* is less than 90 degrees, as shown in FIG. 11. In another embodiment (not shown), the EOAT 100 may tuck or otherwise fold more than one flap inward. This embodiment may include more than one flap tucker 148. Tucking more than one flap provides added flexibility for the downstream equipment.

After the minor flap 142*b* is folded, the flap tucker 148 may rotate in the reverse direction. The minor flap 142*b* may remain folded inward even after the flap tucker 148 is rotated away. In this position, the KDF box 120 is unfurled, and the minor flap 142 is folded inward. This position may be referred to as the open and tucked position.

Figure 12:
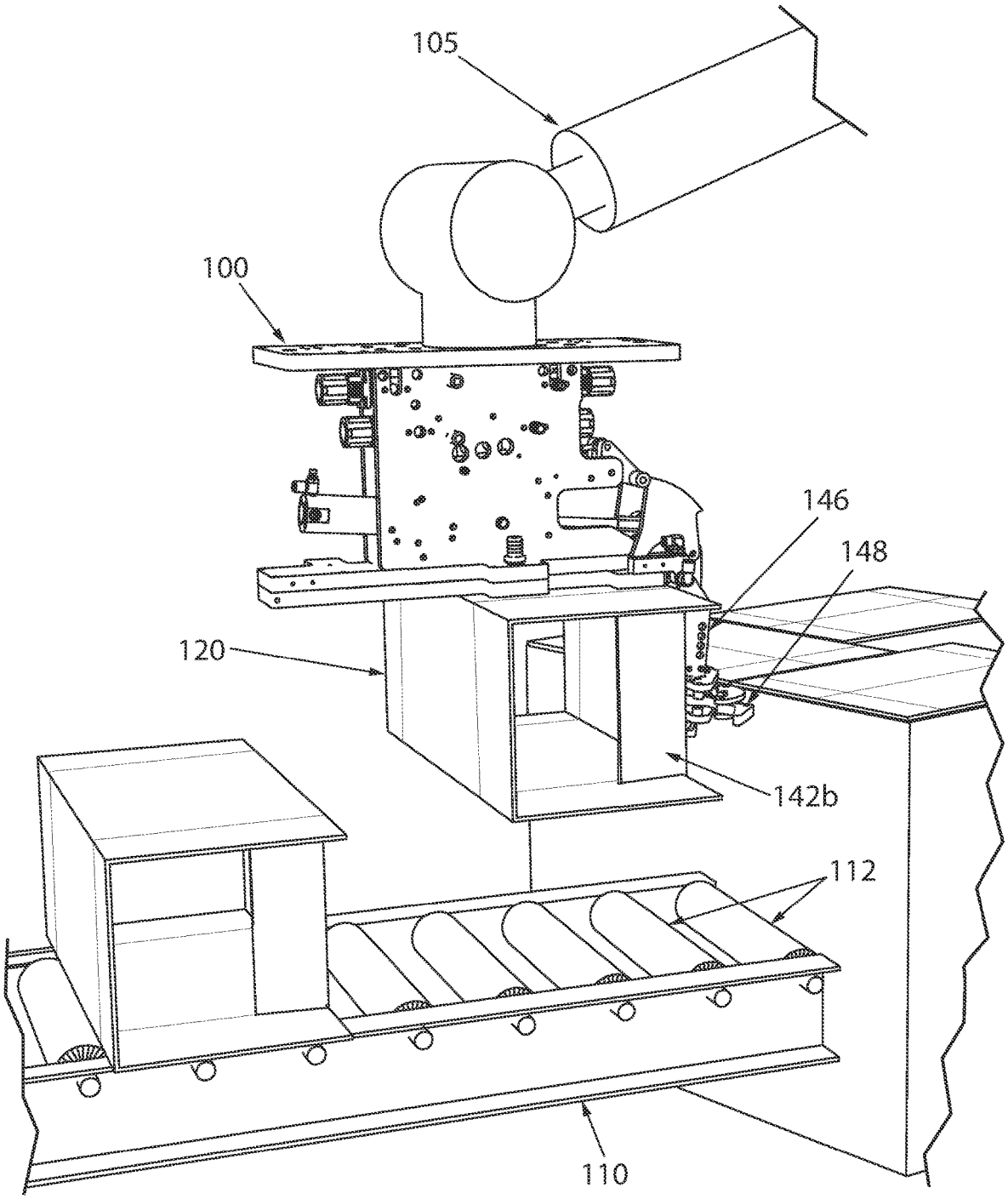
FIG. 12 illustrates a minor flap of a KDF box being folded inward as a box transfer machine moves the KDF box toward a conveyor.
Figure 13:
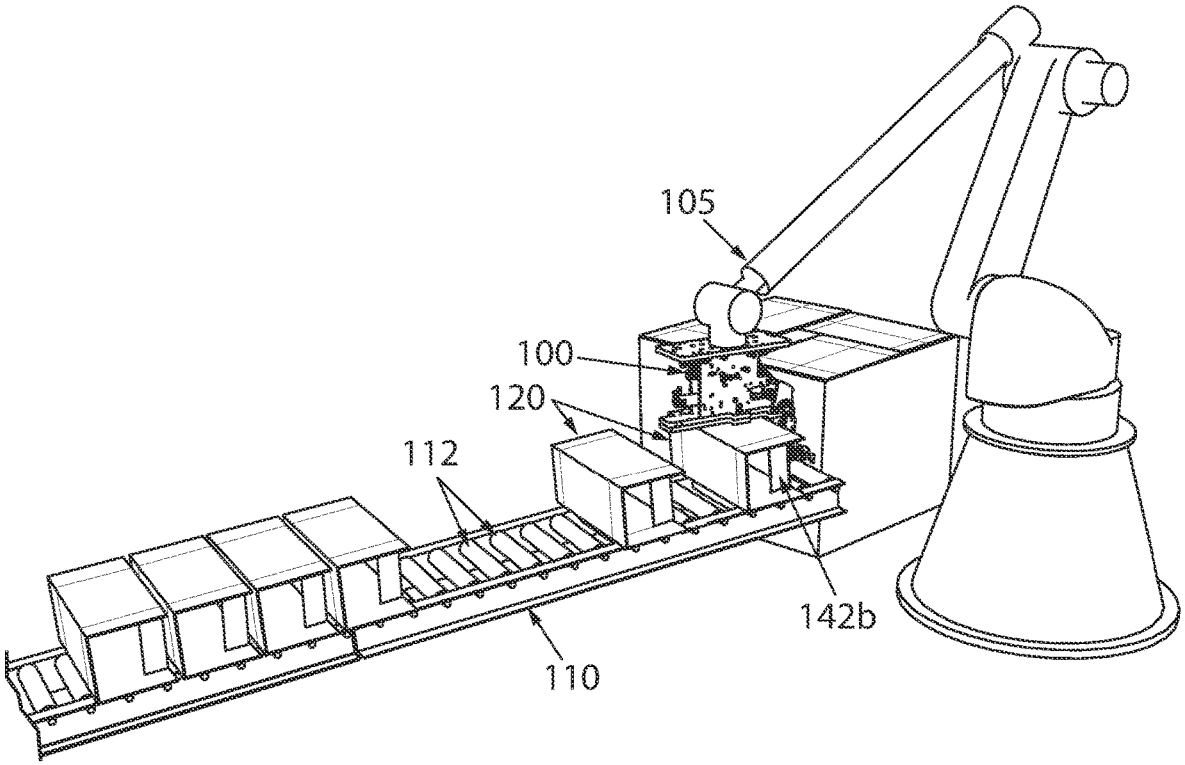
FIG. 13 illustrates a box transfer machine placing an unfurled KDF box with a minor flap tucked on a conveyor.

As illustrated in FIGS. 9-13, while the EOAT 100 is opening the box 120 and tucking the minor flap 142*b*, the box transfer machine 105 may be moving the EOAT 100 and the connected box 120 from the stack 122 to a conveyor 110. When the box 120 arrives at the conveyor 110, the box 120 may be in the open and tucked position, as shown in FIGS. 12 and 13. The box transfer machine 105 may position the EOAT 100 and the box 120 above the conveyor 110.

Figure 14:
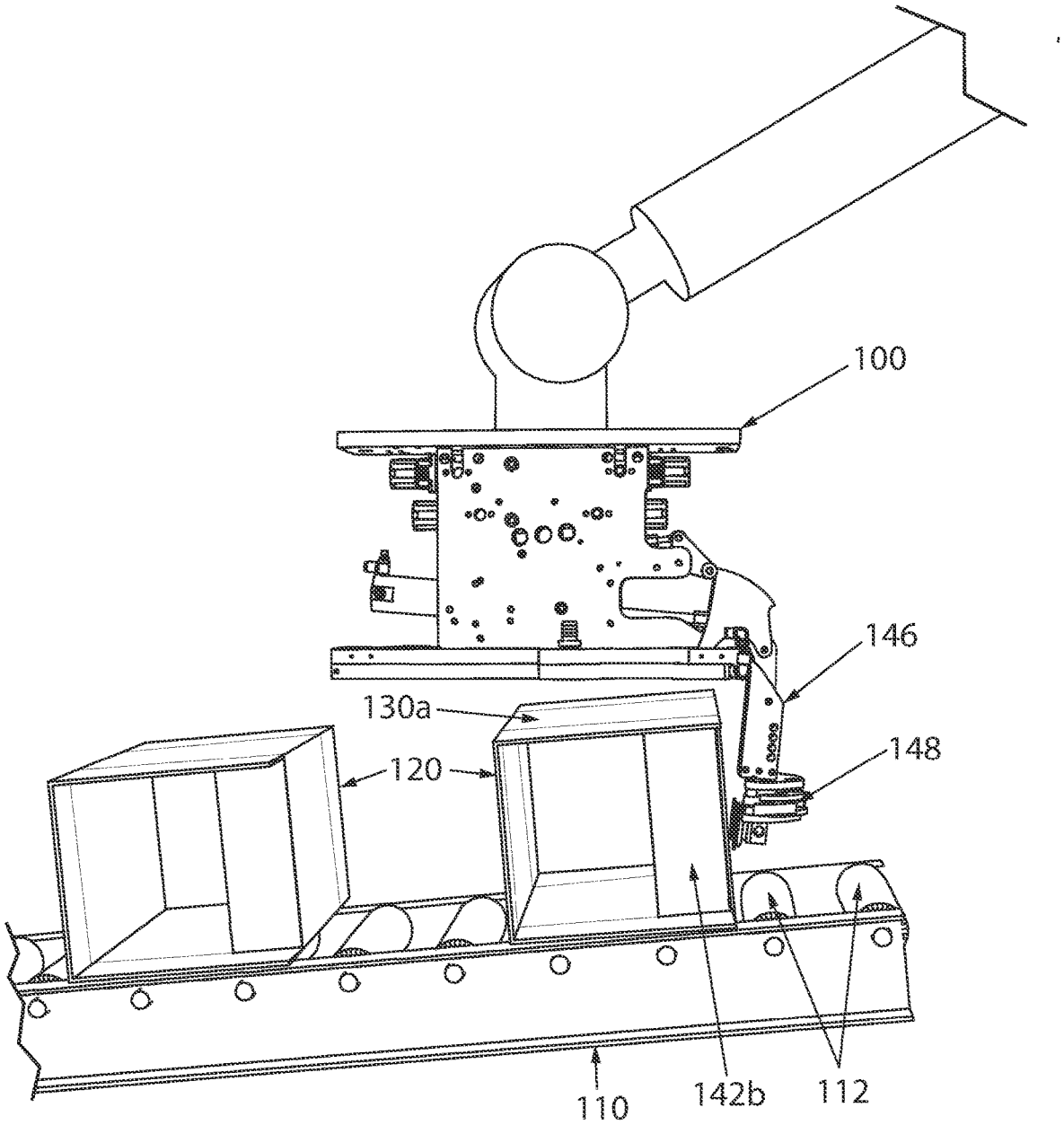
FIG. 14 illustrates a box transfer machine releasing the grip of a KDF box on a conveyor.

As illustrated in FIG. 14, the EOAT 100 may release the box 120 when the box 120 may be positioned on or above the conveyor 110. The major panel gripper may release its grab on the major panel 130*a*, and the minor panel gripper 144 may release its grab on the minor panel 140*b*. In an embodiment where both the major panel gripper and the minor panel gripper 144 may be vacuums, the vacuums may stop providing sufficient suction to maintain hold of the major panel 130*a* and the minor panel 140*b* causing the box 120 to be released on the conveyor 110. In another embodiment, the EOAT 100 may release the box 120 several inches above the conveyor 110.

The major panel gripper, minor panel gripper 144, and flap tucker 148 may also release at different times. The major panel gripper may release first, allowing the box 120 to contact the conveyor 110. Once the box 120 contacts the conveyor, the minor panel gripper 144 and the flap tucker 148 may also release.

After the box 120 may be released on the conveyor 110, the box 120 may maintain the open and tucked position. When set down on the bottom major panel 130*b*, the top major panel 130*a* rests on or presses against the edge of the tucked minor flap 142*b*. The tucked minor flap 142 may support the box 120 and may help the box 120 maintain the open and tucked position. Because of the tucked minor flap 142*b*, the box 120 may remain open and avoid folding flat.

Figure 6:
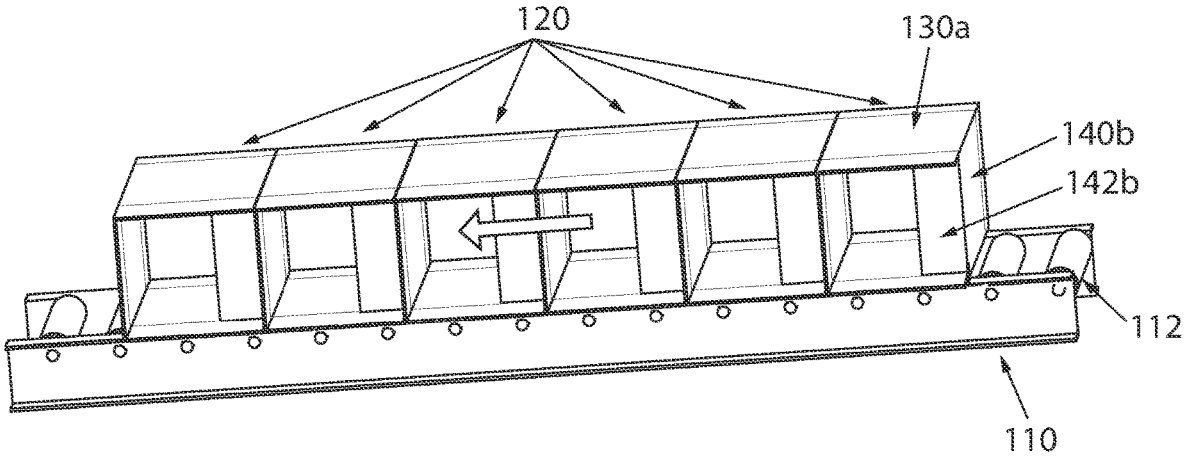
FIG. 6 illustrates multiple KDF boxes on a conveyor being held open by minor flaps being folded inward.
Figure 16:
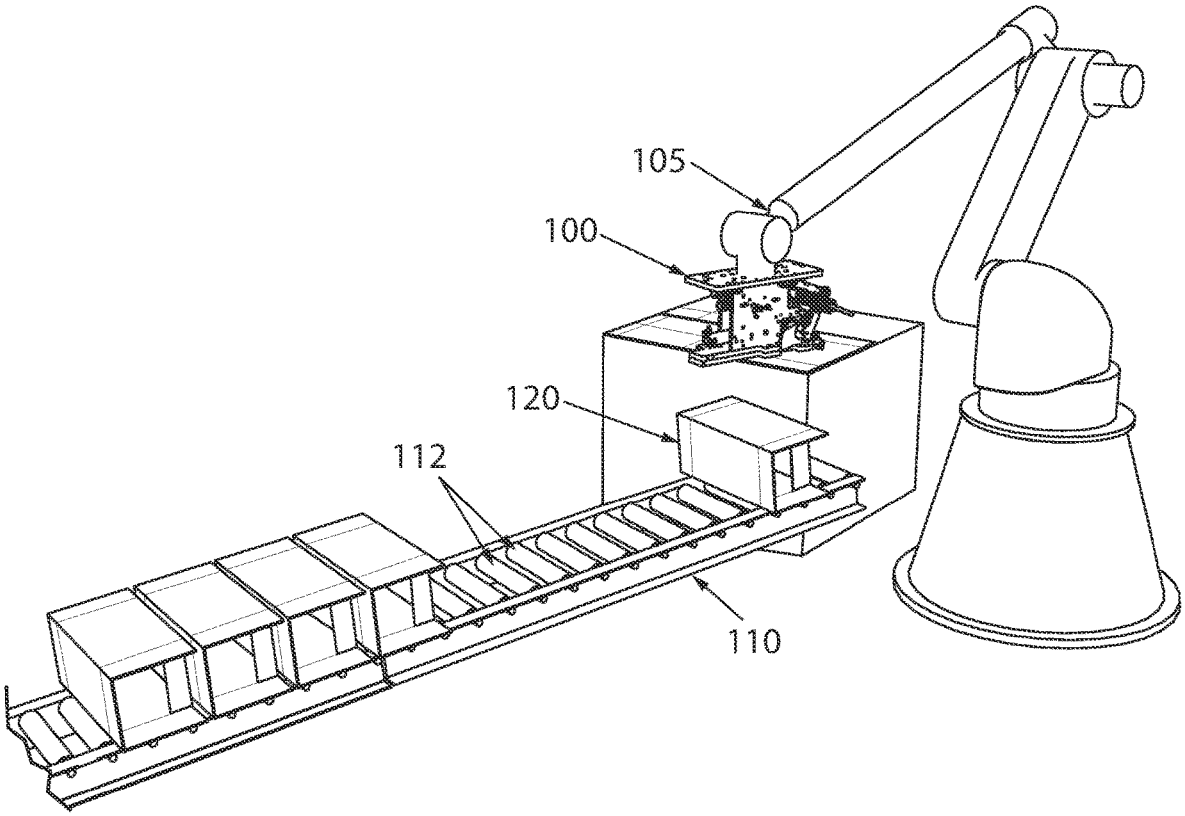
FIG. 16 illustrates multiple KDF boxes on a conveyor after an EOAT placed the KDF boxes on the conveyor.

As FIGS. 6 and 16 illustrate, after the box 120 is released on the conveyor 110, the conveyor 110 moves the open and tucked box 120 to a new location. In one embodiment, the conveyor 110 may be comprised of multiple cylindrical rollers 112 capable of rotating. The conveyor 110 may be positioned on a slant so that gravity may cause the box 120 to slide down the slant on the rotating rollers 112. In another embodiment, the rollers 112 may be powered to spin in one direction to move the box 120 down the conveyor 110. In yet another embodiment, a moving belt may be used for the conveyor 110.

The conveyor 110 may send multiple boxes 120 in the open and tucked position to a new location that may be dedicated to loading or securing the KDF boxes 120. For example, boxes 120 in the open and tucked position may be accumulated at the end of the conveyor 110, as shown in FIG. 16. Because the KDF boxes 120 have already been opened, the open and tucked boxes 120 may be rapidly loaded, taped, or sealed.

Figure 15:
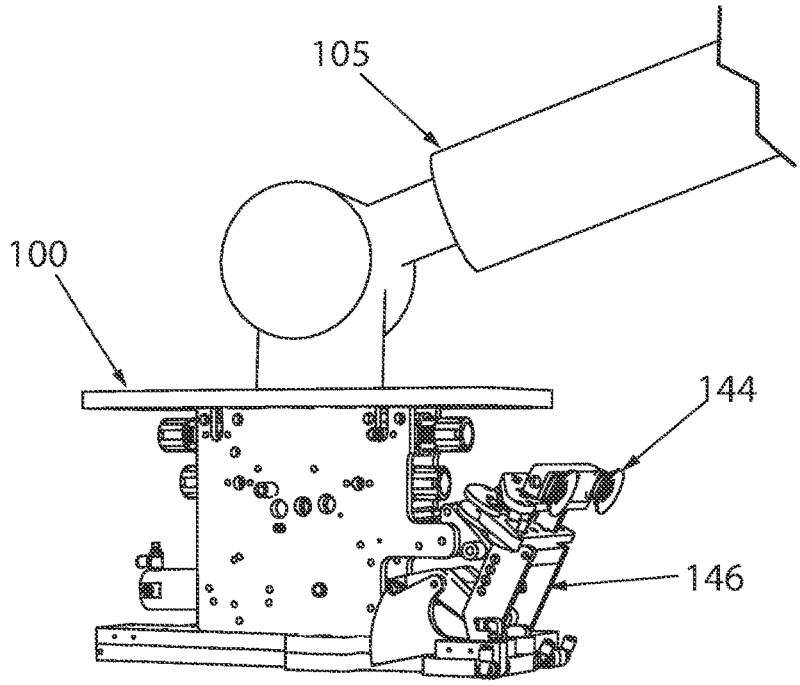
FIG. 15 illustrates a box transfer machine moving an EOAT away from a KDF box after the KDF box has been released onto a conveyor.
Figure 15:
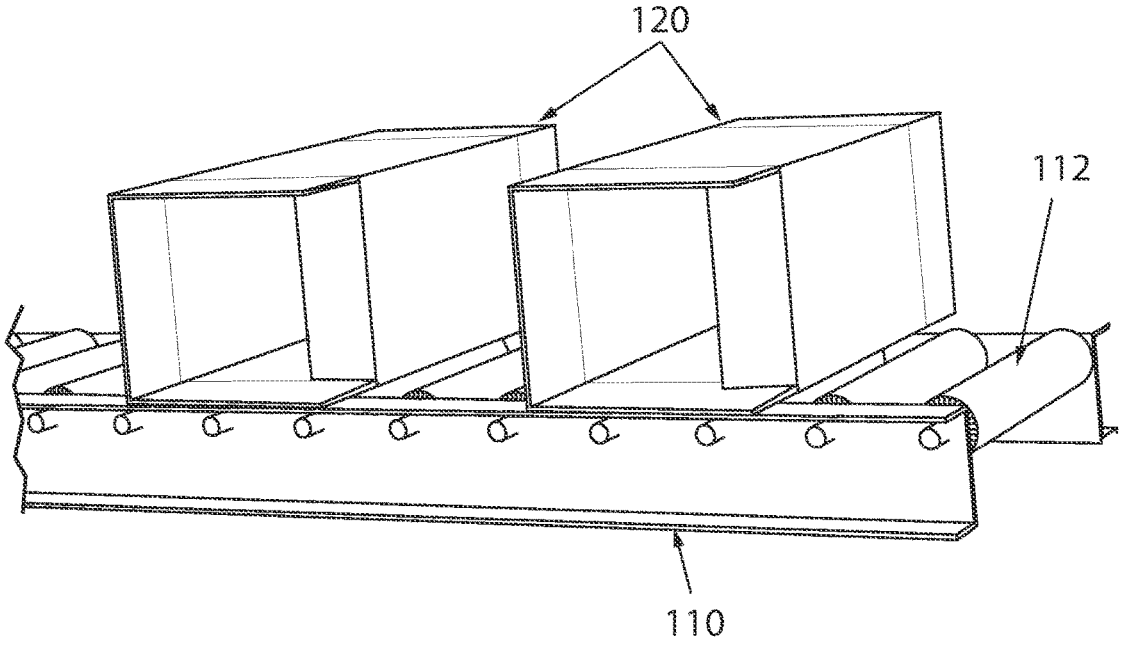

After the EOAT 100 releases the KDF box 120 on the conveyor 110, the box transfer machine 105 may move the EOAT 100 back to the stack 122 to repeat the process. As shown in FIG. 15, the EOAT 100 may move away from the box 120, and the minor panel arm 146 may rotate back to its original position. When the box transfer machine 105 moves the EOAT 100 back to the stack 122, the box transfer machine 105 may position the EOAT 100 over the major panel 130*a* of a flat KDF box 120 to repeat the process on a new box 120.

Figure 17:
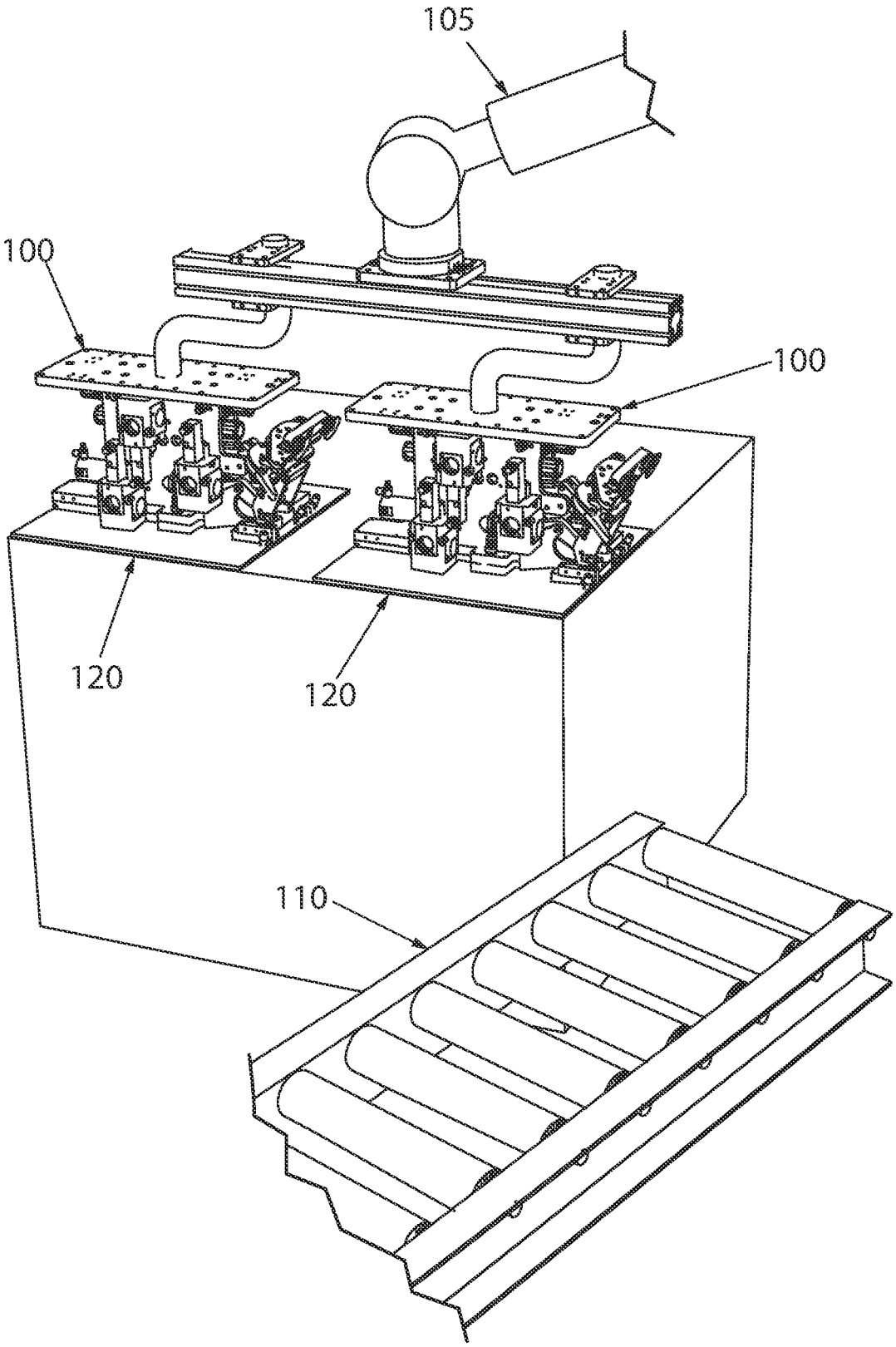
FIG. 17 illustrates another embodiment having two EOATs connected to a single box transfer machine contacting two KDF boxes.
Figure 18:
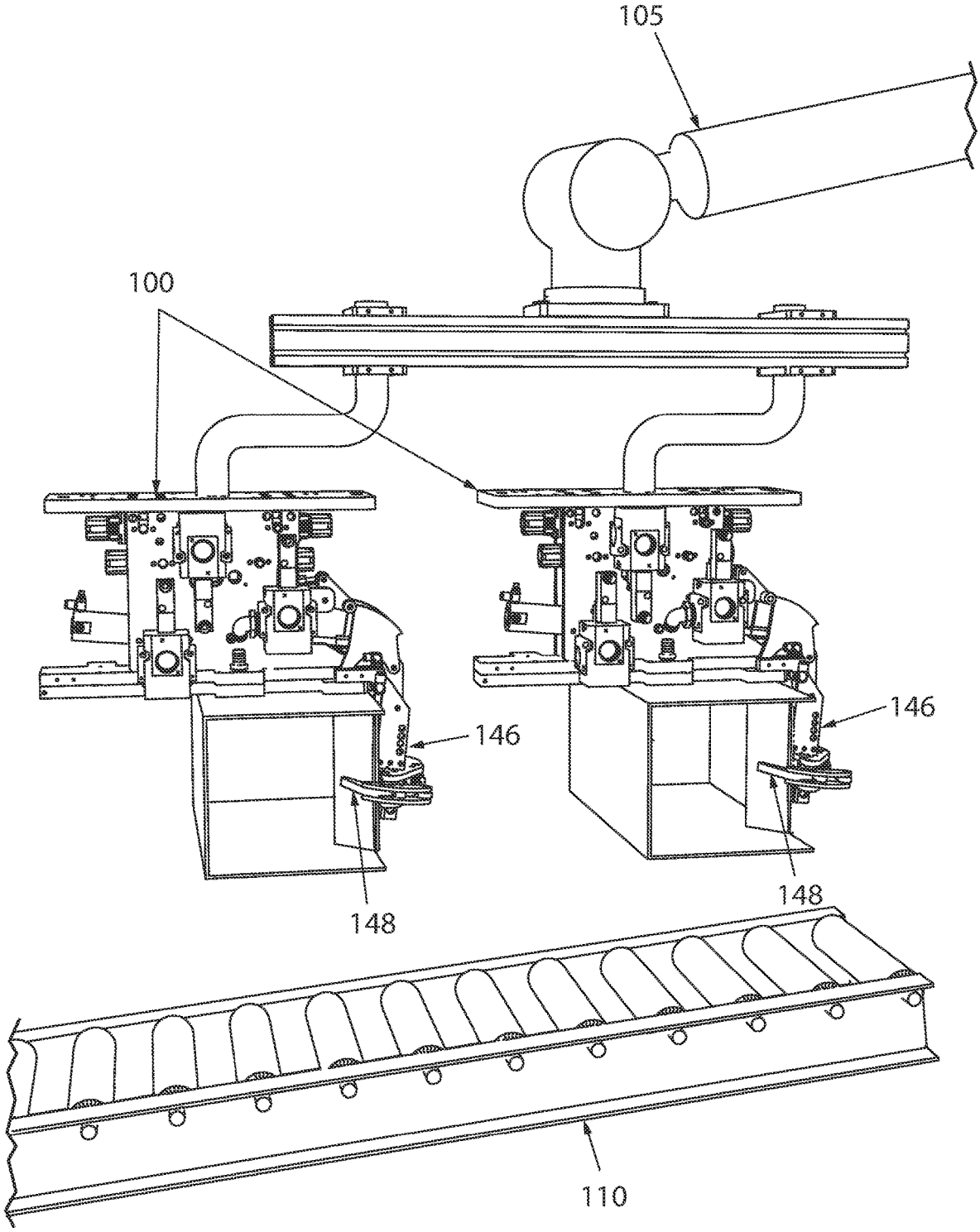
FIG. 18 illustrates the embodiment from FIG. 17 having two EOATs unfurl KDF boxes as the box transfer machine moves the two EOATs toward a conveyor.

As shown in FIG. 17, two or more EOATs 100 may be connected to a box transfer machine 105. Utilizing two EOATs 100 on one box transfer machine 105 may increase the speed and efficiency of the process as two boxes 120 may be opened in the time it takes for the box transfer machine 105 to move the boxes to a conveyor 110 or secondary location. As shown in FIG. 18, each EOAT 100 can lift a box 120, unfurling the box 120, and tucking a minor flap 142*b*. Each EOAT 100 may then drop its respective box 120 on a single conveyor 110. In other words, two EOATs may double the production of the process.

The box transfer machine 105 may also have the ability to sense if a box 120 is unable to be unfurled. Typically, a certain percentage of boxes 120 in a stack 122 are glued in the flat position and are unable to be unfurled. The box transfer machine 105 senses if a box 120 is not unfurling. Rather than pausing the process to be addressed manually, the box transfer machine 105 transports the flat box 120 to a separate location for rejected boxes 120 and disposes of the flat box 120. The box transfer machine 105 then continues unfurling boxes 120 from the stack 122 in the method described above.

The present invention may also be described as a random size case erector. The EOAT 100 may allow the box transfer machine 105 to unfurl various boxes 120 of random sizes. The same EOAT 100 may be used to unfurl a relatively large box 120 as well as a relatively small box 120.

I claim:

1. A method of opening a flat box that includes first, second, third and fourth side walls, comprising:

providing a box opening tool that includes:

a first gripper connected to a body;

an arm extending from the body having freedom of movement to rotate around a first axis; and a finger moveably interconnected with the arm;

abutting the first gripper with the first side wall of the box at a first location;

gripping the first side wall of the box with the first gripper;

transporting the box opening tool and the box from the first location to a second location;

unfurling the box with the arm such that the second and fourth side walls are unfolded relative to the first side wall and the third side wall is spaced from the first side wall, to thereby form an unfurled box;

orienting the unfurled box such that the first and third side walls of the box are oriented generally horizontally;

engaging a flap extending from one of the second and fourth side walls of the box with the finger and rotating the finger so as to push the flap to a tucked position, wherein in the tucked position the flap is positioned between an unfolded flap extending from the first side wall and an unfolded flap extending from the third side wall;

releasing the box from the box opening tool to a location at which the box is supported from below while maintaining the unfurled box in an orientation in which the first and third side walls of the box are oriented generally horizontally; and maintaining the box in the unfurled position after the box is released solely from the flap of the box being in the tucked position between the unfolded flap extending from the first side wall and the unfolded flap extending from the third side wall.

2. The method of claim 1, wherein the box opening tool includes a second gripper connected to the arm, and wherein unfurling the box with the arm comprises:

rotating the arm in a first direction such that the second gripper contacts the second side wall of the box;

gripping the second side wall of the box with the second gripper; and rotating the arm in a second direction opposite the first direction causing the box to unfurl.

3. The method of claim 1, wherein unfurling the box with the arm comprises:

pushing the second side wall with the arm.

4. The method of claim 1, further comprising:

loading and sealing the box.

5. The method of claim 1, wherein, transporting the box from the first location to the second location occurs simultaneously with unfurling the box with the arm; and rotating the finger to push the flap of the box to the tucked position.

6. The method of claim 1, wherein releasing the box comprises releasing the box on a conveyor, and further comprising the step of:

transporting the box to a third location via the conveyor.

7. The method of claim 1, further comprising:

providing a stack of boxes, wherein the box is on top of the stack;

returning the box opening tool to the stack after releasing the box;

abutting the first gripper with a second box;

gripping the second box with the first gripper;

removing the box opening tool and the second box from the stack of boxes;

sensing the second box is not unfurled; and transporting the second box to a third location.

8. The method of claim 1, wherein, the box is released above a conveyor causing the box to drop in free fall.

9. An apparatus for use in converting a container from a flat configuration to a partially erected configuration, wherein the container has a first side wall, a second side wall, a third side wall and a fourth side wall that are foldably interconnected, and at least one foldable end flap extending from each of the side walls, comprising:

a first gripper arrangement that is engageable with the side first wall of the container when the container is in the flat configuration;

a second gripper arrangement movably interconnected with the first gripper arrangement, wherein the second gripper arrangement is engageable with the second side wall of the container while the first gripper arrangement is engaged with the first wall, wherein the second side wall is foldably interconnected with the first side wall, and wherein the second gripper arrangement is operable to move the second side wall to an unfolded position relative to the first side wall, wherein in the unfolded position the second and fourth side walls are unfolded relative to the first side wall and the third side wall is spaced from the first side wall, and wherein when the box is in the unfolded position the first and second gripper arrangements function to orient the first and third side walls of the box generally horizontally; and a folding member movably extending from the second gripper arrangement, wherein the folding member is engageable with an end flap of the container that extends from the second side wall while the second gripper arrangement is engaged with the second side wall and the first and third side walls of the box are oriented generally horizontally, wherein the folding member is engageable with the end flap via rotation of the folding member, and wherein the folding member is configured to move the end flap inwardly relative to the second side wall to a position in which the end flap that is folded inwardly by the folding member is positioned between and engages an unfolded end flap extending from the first side wall of the container and an unfolded end flap extending from the third side wall of the container located opposite the first side wall, wherein engagement of the end flap that is folded inwardly by the folding member with the unfolded end flap extending from the first side wall of the container and the unfolded end flap extending from the third side wall of the container is operable to maintain the container in the partially erected configuration while the first and third side walls of the box are oriented generally horizontally when the first and second side walls of the container are released by the first and second gripper arrangements, respectively.

10. The apparatus of claim 9, further comprising:

a transfer mechanism moveably interconnected with the apparatus, wherein the transfer mechanism positions the first gripper arrangement to engage with the first side wall of the container and transport the container.

11. A method of partially erecting a container from a flat configuration to a partially erected configuration, wherein the container has a first side wall, a second side wall, a third side wall and a fourth side wall that are foldably interconnected, and first, second, third and fourth foldable end flaps interconnected with the first, second, third and fourth side walls, respectively, comprising:

engaging a first gripper arrangement with the first side wall of the container when the container is in the flat configuration;

engaging a second gripper arrangement with the second side wall of the container while the first gripper arrangement is engaged with the first side wall;

moving the second and fourth side walls to an unfolded position relative to the first side wall via movement of the second gripper arrangement, wherein in the unfolded position the second and fourth side walls are unfolded relative to the first side wall and the third side wall is spaced from the first side wall;

orienting the container such that the first and third side walls container are oriented generally horizontally;

moving the second end flap inwardly relative to the second side wall via operation of a folding member interconnected with the second gripper arrangement to a position in which the second end flap is positioned between and engages the unfolded first end flap and the unfolded second end flap; and releasing the first and second side walls of the container from the first and second gripper arrangements, respectively, to a location at which the box is supported from below while maintaining the container in an orientation in which the first and third side walls of the box are oriented generally horizontally, wherein engagement of the second end flap between the unfolded first end flap and the unfolded third end flap is operable to maintain the container in the partially erected configuration when the first and second side walls of the container are released by the first and second gripper arrangements, respectively.

12. The method of claim 11, wherein the container in the partially erected configuration is oriented such that a cavity defined by the first, second, third and fourth side walls extends along a generally horizontal axis.

13. The method of claim 12, wherein the partially erected container is supported from below by a conveyor.

* * * * *